US010074936B2

(12) United States Patent
Dong et al.

(10) Patent No.: US 10,074,936 B2
(45) Date of Patent: Sep. 11, 2018

(54) SECURE LOCKING SOCKETS

(71) Applicant: Kaizheng Dong, Union City, CA (US)

(72) Inventors: Kaizheng Dong, Union City, CA (US); Yuanhui Dong, Union City, CA (US)

( * ) Notice: Subject to any disclaimer, the term of this patent is extended or adjusted under 35 U.S.C. 154(b) by 0 days.

(21) Appl. No.: 15/470,943

(22) Filed: Mar. 28, 2017

(65) Prior Publication Data

US 2018/0006403 A1 Jan. 4, 2018

Related U.S. Application Data

(60) Provisional application No. 62/357,935, filed on Jul. 1, 2016.

(51) Int. Cl.
*H01R 13/639* (2006.01)
*H01R 25/00* (2006.01)

(52) U.S. Cl.
CPC ..... *H01R 13/6395* (2013.01); *H01R 25/006* (2013.01)

(58) Field of Classification Search
CPC ..... H01R 13/6395; H01R 13/10
See application file for complete search history.

(56) References Cited

U.S. PATENT DOCUMENTS 2,865,011 A * 12/1958 Dejadon ..... H01R 4/50 439/263
4,085,991 A * 4/1978 Marshall ..... H01R 13/20 439/346
5,082,450 A * 1/1992 Warren, Sr. ..... H01R 13/6395 439/102
5,129,836 A * 7/1992 Ursich ..... H01R 13/6276 439/346
5,197,897 A * 3/1993 Torok ..... H01R 13/20 439/105
5,551,884 A * 9/1996 Burkhart, Sr. ..... H01R 13/20 439/140
5,791,931 A * 8/1998 Burkhart, Sr. ..... H01R 13/20 439/304
5,893,772 A * 4/1999 Carmo ..... H01R 13/639 439/346
6,193,539 B1 * 2/2001 Chang ..... H01R 13/6278 439/346
6,461,176 B1 * 10/2002 Haas ..... H01R 31/065 439/133
6,979,220 B1 * 12/2005 Ray ..... H01R 13/6392 439/346
7,077,683 B1 * 7/2006 Ross ..... H01R 13/20 439/346
7,083,458 B1 * 8/2006 Chang ..... H01R 13/6392 439/263
7,104,818 B1 * 9/2006 Chang ..... H01R 13/629 439/137
7,232,349 B1 * 6/2007 Chen ..... H01R 13/6392 439/810

(Continued)

*Primary Examiner* — Briggitte R Hammond

(57) ABSTRACT

The invention relates generally to a lockable socket. In one example embodiment, to methods, apparatus, and systems to a safe electrical socket, wherein the socket may lock such that the plug, wires or connectors may not be accidently or forcibly removed without activation or deactivation of the locking structures. The locking mechanism may include a cam like actuator and locking mechanism that provides a secure and strong mechanism.

19 Claims, 12 Drawing Sheets

(56) References Cited

U.S. PATENT DOCUMENTS

| | | | | |
|---|---|---|---|---|
| 7,241,188 | B2 * | 7/2007 | Lin | H01R 4/4863<br>439/838 |
| 7,484,986 | B1 * | 2/2009 | Wu | H01R 13/6275<br>439/346 |
| 7,497,705 | B2 * | 3/2009 | Larson | H01R 13/6397<br>439/133 |
| 2002/0068474 | A1 * | 6/2002 | Davidson | H01R 13/6392<br>439/346 |
| 2002/0137397 | A1 * | 9/2002 | Little | H01R 13/501<br>439/686 |
| 2005/0124200 | A1 * | 6/2005 | Nudd | H01R 13/6397<br>439/346 |

* cited by examiner

SECURE LOCKING SOCKETS

This application claims priority from at least U.S. Provisional Patent Application 62/357,935, filed on Jul. 1, 2016, entitled "Secure Locking Sockets", which application may be incorporated herein by reference in its entirety for all purposes.

FIELD OF TECHNOLOGY

This disclosure relates generally to a socket. In one example embodiment, to methods, apparatus, and systems to a safe electrical socket, wherein the socket may lock such that the plug, wires or connectors may not be accidently or forcibly removed without activation or deactivation of the locking structures.

BACKGROUND

Within the United States, electricity use and means are regulated by the International Electrotechnical Commission (IEC) and the domestic National Electrical Manufacturers Association (NEMA). US regulations often demands 1-15 or 5-15 type NEMA connectors and plugs, among other types of standard plugs. Typical outlets have voltage ratings from 125 to 600 volts, with electricity passing from female outlets to male plugs.

Electricity consumption in the United States has risen by almost 2,000 kWh since 1990, highlighted by the growing popularity of domestic use such as smart phones, televisions, tablets, etc. and the growing number of outlets in the average American household. Accordingly, demand has increased for efficient, secure means with which to utilize this electric energy. Yet current iterations of electrical outlets may allow corresponding plugs to come loose due to their lacking locking functions, simultaneously exposing the outlet and preventing current flow and thereby impeding on the purpose of the outlet and creating safety hazards whereby the outlet may be exposed. This may cause a danger, both to adults, wherein the disconnection may be accidental, but also to children and other at risk populations where the disconnection may also be accidental but also on purpose by the individual.

NEMA 5-15 and 1-15 plug outlets are marked by certain characteristics and may include copper socket housing with two symmetrically arranged, copper fixed and mounted sockets provided in the housing. Its front end may be disposed inside the housing shell top body while corresponding to its front end may be a jack plug socket connector which inserts through the front end of the plug socket copper; the copper socket provided at the end of the outer housing may be for connecting power lines. However, during use, these typical sockets may succumb to pulling of the male plug and may create separation between the male plug and female socket, creating a safety risk. Thus, there is a need for an invention that prevents this separation, allowing the socket to continue to exchange current while protecting the safety of those using the socket.

There exists functions and performances which necessitate proper electricity flow to be successful. For example, outlets are depended upon to deliver energy to sustain medical equipment, lighting, and other such uses. In some cases, as with children or residents with dementia or other mentally debilitating conditions, it may be undesirable to have outlets which allow for male plugs to slip or otherwise be removed from outlets instead of providing necessary functions. Current outlet models, both grounded and ungrounded, may be susceptible to such dangers as current regulations on NEMA plugs and outlets do not exist regarding staying ability.

In order to prevent removal, current plugs and sockets have employed various methods, such as electronic locks, etc. Yet these methods may be of complex structure, high cost of production, and difficult and/or costly to implement in homes. Due to the multitudinous nature of outlets in homes, hospitals, and other day-to-day locations, costly or difficult implementation may dissuade residents from implementing safety precautions at the cost of their own well-being. Thus there is a need for an invention which may cheaply and efficiently ensure continued use of outlets while preserving safety measures with a locking function.

Therefore, there is a need for an invention providing a device which may be used to ensure the safe and continued use of electricity, relating generally to a lockable electrical socket device such as to provide lockable functions while maintaining cost-efficiency.

SUMMARY

Disclosed are methods, apparatus, and systems that provide a safe electrical socket, wherein the socket may be locked such that the wires or connectors may not be accidently or forcibly removed without activation or deactivation of the locking structures.

The locking socket, in an embodiment, may include a safety socket comprising of at least a housing and at least two copper sockets.

The present invention socket may then also include a housing or main body which may further include an oval cam shaft, a lock piece, an elastic or spring operated member and a positioning axis. When the plug is inserted into the safety socket, the oval cam shaft may rotate by a drive, such as a shaft operated by the user, and two oval cam major axis vertices may be squeezed to the sides of the rear end of the lock piece. Outside of the lock piece, positioned along the axis of rotation, the trailing end of the lock piece may overcome the elastic stretching member, and linked to the front end of the lock piece of copper through the locating slot on the socket, is inserted into the plug hole in the sheet, pulling the plug security restrictions socket. The oval cam end, when driven by rotation, is in contact with the lock piece of the long axis vertex to vertex with minor changes. The elastic member pressing the end of the outer lock piece of sheet may then be positioned along the axis of rotation, the front end of the hook pulled out of the lock piece plug piece hole, and the plug can be pulled free safety socket.

Thus, then through the above summarized mechanism, the socket may provide a locking socket, wherein at the least the socket is able to, through a spring or elastic operation and input by the user, wherein the user may activate a switch or turn mechanism, lock the sockets in place.

From this locked position the socket may be forcibly hard to disconnect or pull the socket out, such that accidental or undesirable disconnection is impossible or made harder. With a switch or turning mechanism, the user can then disengage the secure lock and the sockets may be removed or disconnected. It is noted that the electricity transfer may be completed within the piece, using particular materials such as copper which have a high current ability and low resistance.

The methods and systems disclosed herein may be implemented in any means for achieving various aspects. Other features will be apparent from the accompanying drawings and from the detailed description that follows.

BRIEF DESCRIPTION OF THE DRAWINGS

Example embodiments are illustrated by way of example and are not limited to the figures of the accompanying drawings, in which, like references indicate similar elements.

Figure 1:
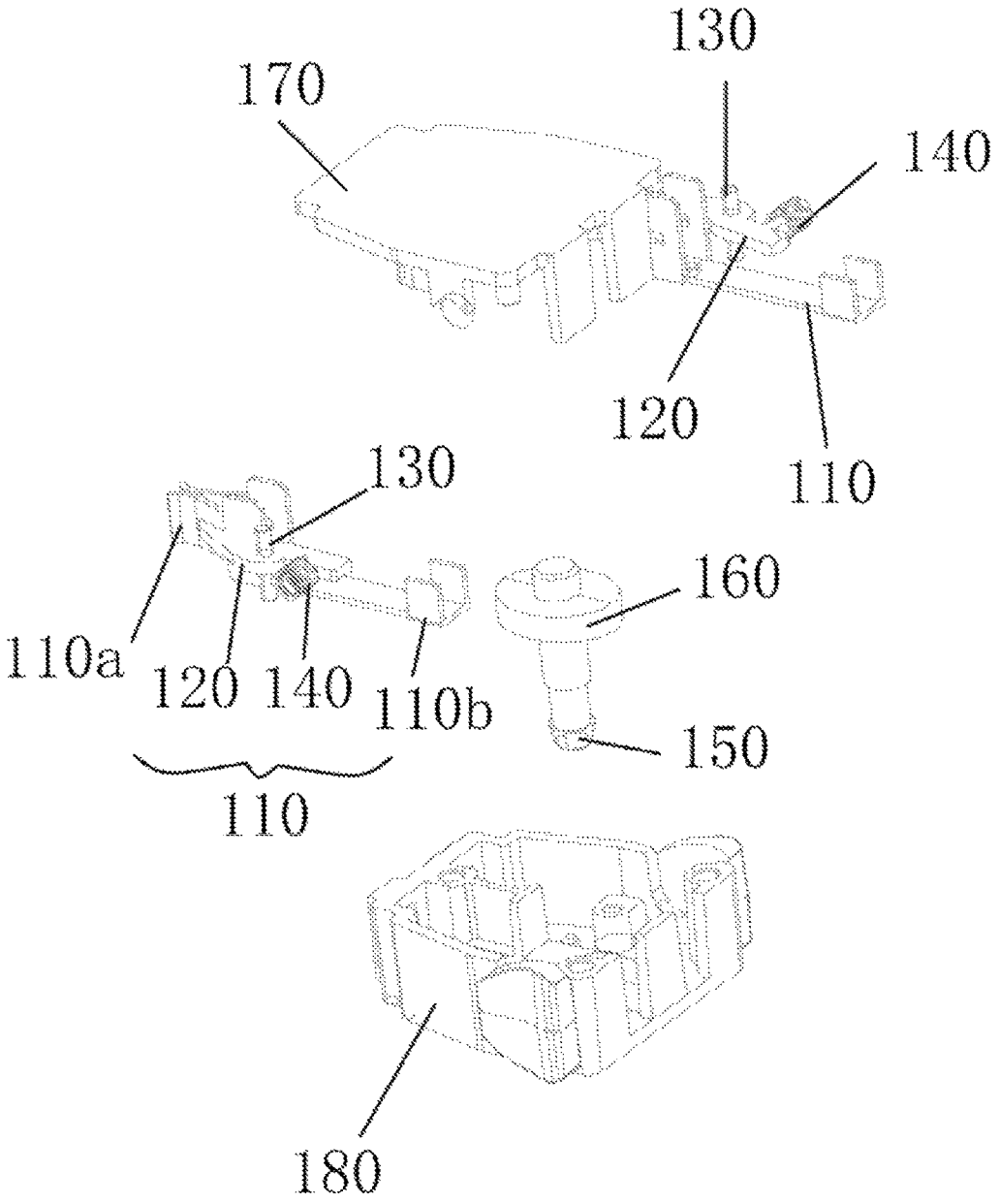
FIG. 1 is an exploded schematic view of an embodiment of the structure of the safety socket of the utility model to an embodiment.

Implementation, features and advantages of the utility model, the purpose of the connection with the embodiment, further described with reference to the accompanying drawings.

Other features of the present embodiments will be apparent from the accompanying drawings and from the detailed description that follows.

DETAILED DESCRIPTION

Disclosed may be methods, apparatus, and systems that may provide a more secure socket apparatus. Although the present embodiments have been described with reference to specific example embodiments, it will be evident that various modifications and changes may be made to these embodiments without departing from the broader spirit and scope of the various embodiments. It should be understood by one of ordinary skill in the art that the terms describing processes, products, elements, or methods may be industry terms and may refer to similar alternatives In addition, the components shown in the figures their connections, couples, and relationships, and their functions, may be meant to be exemplary only, and may be not meant to limit the embodiments described herein. It should be understood that the specific embodiments described herein may be only used to explain the present utility model may be not intended to limit the utility model.

In one or more embodiments, which may be in addition to the above and below embodiments, the present invention may describe a socket.

In one or more embodiments, which may be in addition to the above and below embodiments, the present invention may describe an electrical socket.

In one or more embodiments, which may be in addition to the above and below embodiments, the present invention may describe a plug.

In one or more embodiments, which may be in addition to the above and below embodiments, the present invention may describe an electrical plug.

In one or more embodiments, which may be in addition to the above and below embodiments, the present invention may describe an electrical socket with locking capabilities.

In one or more embodiments, which may be in addition to the above and below embodiments, the present invention may describe an electrical socket with locking capabilities which may comprise of a simple housing structure and conductive material, such as copper, sockets, and may reduce the production cost of safety sockets.

In one or more embodiments, which may be in addition to the above and below embodiments, the present invention may describe an electric socket with locking capabilities which may comprise in part of a simple housing structure. This housing may consist of material constructed such that device components may be held within a hollow space created by surrounding materials, and the housing. The surrounding housing material may be any material, but notably may be nonconductive materials such as plastic, rubber or similar materials, but also may be metal, painted or otherwise made safe, either from deformation or light or heavy use, as well as from electrical shock, especially to the user. Such housing may accomplish one or some of protecting the device, holding components securely, and easing transportation of the device itself. The housing may also be of a clear, opaque or any other type of material.

In one or more embodiments, which may be in addition to the above and below embodiments, the device housing may be crafted of one or multiple materials and may be in any shape, geometric or otherwise, such that desired functions may be accomplished given cost restraints. It is noted that the exact shape as described herein and in the figures may be protected, but also may be of any other shape, such that one skilled in the art would see fit from the usability and function standpoints as described.

In one or more embodiments, which may be in addition to the above and below embodiments, the present invention may describe an electric socket with locking capabilities which may comprise in part of copper or other conductive material sockets, with each socket, recess or prong existing singularly or in multiples based on desired plug and socket compatibilities. Such sockets may be constructed to allow transfer of electricity from socket to electric plug in varying voltages and currents.

In one or more embodiments, the present invention may have one or more, such as two or three recesses, of which a plug may be entered into the housing and locked into the conductor, such as copper, connectors. The plurality of recesses, and connector holes, through the housing may be of any plurality, and may include such as one hot, one ground, or one negative, or one hot, one neutral, and one ground, or any combination of plugs, in any format, whether to any world, country or region standard or proprietary, of which the present invention may also include the same or different extrusions on the opposite side such that current may flow through and such that the socket may be locked and secured to both ends, or one among others.

In one or more embodiments, which may be in addition to the above and below embodiments, it is noted that the part of the copper or other conductive material sockets, and described sockets may be of any material, such that has low resistance and a particularly desired current ability, such as another metal, or any other material. It is noted that the plugs and copper or other material pieces which carry electricity may be of any width, thickness and design, such that the pieces are able to carry electricity as intended without voltage drop, heat creation or any other undesirable aspects or abilities.

In one or more embodiments, which may be in addition to the above and below embodiments, the present invention may describe an electric socket with locking capabilities which may comprise in part of sockets existing singularly or in multiples based on desired plug compatibilities. Such sockets may be constructed to allow transfer of electricity from socket to electric plug in varying voltages and currents.

In one or more embodiments, which may be in addition to the above and below embodiments, it is noted that particularly, the plug as described in the figures may provide for an ability for a US style two prong plug, but it can be seen how the ingenious cam design as described may be applied to many different plug designs such that the plug designs may be able to be locked into the present invention housing structure.

In one or more embodiments, which may be in addition to the above and below embodiments, that the plug and socket and may be compatible with one or multiple electric plugs depending on regulation, style and location. Described sockets may be constructed of one piece for decreased resistance and/or increased conductivity of the socket. In this or other instance, such construction may have two distal ends. In other examples there may be less than two distal ends, or in many cases there may be more such as three, four or more ends. It is noted that each may also be patterned or sized to a specific need.

In one or more embodiments, which may be in addition to the above and below embodiments, the amount of plug ends that are secured may be any percentage or proportion of the ends inserted, such as two out of two ends secured, or two out of four ends secured, as well as any other combination in any plurality, of which may be determined by the economy of manufacturing costs and the amount of securing force for the plug and socket necessary to create a safe socket.

In one or more embodiments, which may be in addition to the above and below embodiments, the device sockets may be crafted of one or multiple materials and may be in any shape, geometric or otherwise, such that desired functions may be accomplished given cost restraints. This may include that shape of the sockets of which may include different materials, such as around the socket area itself a low conductivity material such as plastic may be used for the exterior housing, or in other embodiments, metal may be used for longevity. It is also noted that the socket plugs themselves, may be any plurality as aforementioned, but also may be any shape, design or standard.

In one or more embodiments, which may be in addition to the above and below embodiments, the present invention may describe an electric socket with locking capabilities which may further comprise of an oval cam performing an integral part of the locking function. Such an oval cam may be separate from device housing, in that the manufacture may be different. The described oval cam may allow for ease of use, elongating area around the screw or shaft contained within the oval cam. In one or more embodiments, the oval cam may be located in the middle of two or some number of sockets, of which then the cam interacts with the prongs entered into the sockets to provide for a locking state through friction or other means or design abilities.

In one or more embodiments, which may be in addition to the above and below embodiments, it is noted that the device may utilize oval cam of any shape, geometric or otherwise, and materials based on functionality, given budget, or desired aesthetic.

In one or more embodiments, which may be in addition to the above and below embodiments, the present invention may describe an electric socket with locking capabilities which may further comprise of a drive shaft or other designed shaft or torque transferring structure. The described drive shaft may allow for transmission of torque and rotation within the housing, wherein the rotation and torque may originate from the user such as the user's hand or foot, but also may be from a servo, or other location. Such a shaft, when driven, may allow for rotation of the oval cam within the housing. The drive shaft may then extend through the housing side wall and may connect fixedly to the axis of the oval cam portion. Likewise, the positioning shaft may be symmetrically disposed on both sides of the oval cam and may be fixed to the housing wall using some adhesive or positioning mechanism such as fasteners or rivets, etc.

In one or more embodiments, which may be in addition to the above and below embodiments, the device drive shaft may be constructed of one or multiple of joint and coupling types to accomplish its purpose. In one or more embodiments, the drive shaft may be constructed of any material and its positioning may vary based on functionality, cost restraints, or some combination of these and other desired applications.

In one or more embodiments, which may be in addition to the above and below embodiments, the present invention may describe an electric socket with locking capabilities whose locking piece may be constructed of locking fingers of varying shapes and size corresponding to desired stress levels for the designed stress. Described fingers may be symmetrically disposed at both sides of the elliptic cam, such that the cam may interact with the fingers or pieces, such that the pieces or fingers may lock or provide pressure to the plug, pin or otherwise the piece to be locked. Additionally, components of described locking mechanism may be pivotally connected singularly or in multiplicity to the corresponding positioning axis, and may be of any plurality or positioning.

In one or more embodiments wherein the shaft is secured by a ring molded with or on the shaft or separate to the shaft and wherein captive to the housing.

In one or more embodiments wherein the shaft is secured by a ring molded with or on the shaft or separate to the shaft and wherein the shaft has a split end expansive joint such that when the shaft is pressed through the housing the shaft is compressed, but when exited out the other end expands, securing the shaft and pieces by the expansion.

In one or more embodiments wherein the shaft is secured by a ring molded with or on the shaft or separate to the shaft and wherein the shaft is secured by a screw or any other method, such as the shaft internally threaded and wherein a screw or plate is screwed into the shaft, such that the shaft is secured within the housing.

In one or more embodiments, which may be in addition to the above and below embodiments, the device fingers or pieces may provide desired locking capability through friction, obstruction of movement, or some other methods of preventing removal of prongs of an electric plug inserted in the device. Accordingly, finger construction, orientation, and material may vary based on functionality, cost restraints, aesthetic of device, or some combination of these and other desired applications.

In one or more embodiments, which may be in addition to the above and below embodiments, the fingers, through the rotating of the cam, may provide pressure onto the plug to be secured, such that the friction provides for a difficulty for removal. It is also is noted that the friction may be applied to any axis or direction.

In one or more embodiments, which may be in addition to the above and below embodiments, the rotation of the cam may provide for a structure, such as the described fingers, but also may be of another design, such as the cam providing for a rotation and movement of a mechanism which lessens the opening in which the plug to be secured is entered into, and as such provides that the opening becomes less than the size of the plug and then cannot be forcibly removed. It is noted that many other designs may be appreciated using the cam such as providing for a piece, such as a pin or extrusion wherein the cam actuates the structure such that a pin or extrusion goes through a hole in the plug to be secured, or wherein the pin or extrusion grooves into a depression in the plug to be secured.

In one or more embodiments, which may be in addition to the above and below embodiments, the screw as aforementioned that actuates the cam may have an enlarged portion, either one piece with the screw or multiple pieces which allows for additional torque to be enlisted by the user to actuate the cam. It is also noted that the cam or actuation may provide for pivot points, wherein the natural resting position provides for torque of the shaft and structure may provide for the structure and cam to want to rest or force itself to a rest in either the locked or unlocked positions at different points of its travel, such that the lock provides for a secure lock or unlock position, and may not easily or accidently jostled or hit out of the current locked or unlocked state.

In one or more embodiments, which may be in addition to the above and below embodiments, the present invention may describe an electric socket with locking capabilities whose distal end of the locking component may be provided with a hook on opposing sides of the apparatus. Such a hook may be allowed to pivot about a staying device such as a screw such that the hook may place force of varying degrees upon other components of the device, depending on its pivot degree.

In one or more embodiments, which may be in addition to the above and below embodiments, the present invention may describe an electric socket with locking capabilities wherein the cam lever may provide a friction force depending on the angle of the came and shaft position.

In one or more embodiments, which may be in addition to the above and below embodiments, the present invention may describe an electric socket with locking capabilities wherein the cam lever may provide a friction force depending on the angle of the came and shaft position, wherein the shaft and selector position when locked provides the largest amount of friction force, and wherein the cam then allows for a lessened force to be transmitted to the shaft, such that the shaft and selector require a rise in force to be moved out of the unlocked and locked positions at the extreme range of movement, such as when locked and unlocked.

In one or more embodiments, which may be in addition to the above and below embodiments, the device hook or hooks described may be of varying curvature, material, and rigidity, such that the hook or hooks may withstand force or strain given desired functionality or cost considerations and may lock into another socket, or via a plug to be locked or secured.

In one or more embodiments, which may be in addition to the above and below embodiments, the device may describe a resilient member hook of which may be symmetrically disposed at both sides of the elliptic cam, and may be disposed outside of the two members on the opposite rear end of the lock piece, with one end of the elastic pressing member such as a spring or other device such as a torsion bar or lever, contacting said housing inner wall and the other end of the extrusion contacting the trailing end of the corresponding outer locking fingers. Exact positioning may vary based on device construction considerations.

In one or more embodiments, which may be in addition to the above and below embodiments, it may be noted that for economy of language, the hook and finger sides, and the aforementioned and latter mentioned abilities may be made of one or more pieces, such as out of copper or any other materials, such that the structure abilities described and present.

In one or more embodiments, which may be in addition to the above and below embodiments, the present invention may describe an electrical socket with locking capabilities and varying number of openings, allowing for use of desired plug type. Thus, the plug contact positions corresponding to the copper sockets provided in one or more embodiments may include one or multiple corresponding plug hole positioning grooves. When the desired plug is inserted into the safety socket, the two major axis vertices of the oval cam lock piece may press the trailing end of the lock outer sheet positioned along the axis of rotation. This may occur to varying degrees of force, depending upon the design of the system and desired function, and may be adjustable by the user the input screw, or may be designed by the manufacture via the angle or shape of the cam and corresponding pieces and structures.

In one or more embodiments, which may be in addition to the above and below embodiments, pressure on the trailing end of the lock outer sheet may result subsequently in elliptical rotation of the cam shaft. Such rotation may result in the locking of the socket by elastic force acting against the end of the elastic member, linked to the front end of the lock piece of the socket through the locating slot, which may be inserted into the plug hole in the sheet.

It is noted that the term elastic is used for economy of words and may be replaced or be in addition to a described spring, or other forces or abilities.

In one or more embodiments, which may be in addition to the above and below embodiments the device elastic member may be a compression spring or other such formation accomplishing elasticity to a desired degree. Thus based on particular use, such a member may exist in varying elasticity levels. Such a member may be made of any substance capable of withstanding tension such that the desired application may be met, given various restraints not limited to cost, application, and considerations for other components, this may include a band, a spring, a lever, torsion bar amount others.

In one or more embodiments, which may be in addition to the above and below embodiments, there may be a pull limit allowing plugs to be removed from the socket. When driven by the drive shaft, the oval cam may be allowed to rotate such that the contact end of the oval cam lock piece and the long axis of the vertex to vertex minor shifts. Accordingly, in one or a combination of occurrences, the elastic member may press the lock piece at the end of the lock outer sheet positioned along the axis of rotation, the front end of the hook lock piece may be pulled out of the hole plug inserts, and the plug may be pulled free of the safety socket. In this order or otherwise, the device may therefore be lockable for inserted systems. Pull limits may exist in varying levels based, among other considerations, on specific device considerations and plug types, as well as the desired use and in design consideration for other systems such as the pull limit of the wires themselves, or other uses.

In one or more embodiments, which may be in addition to the above and below embodiments, the shaft portion of the lockable electric socket may be located outside the housing and provided with a handle. To allow for handle attachment, the free end of the drive shaft may be provided with one or multiple of the following: expansion chuck and mounting hole on the handle. Said expansion chuck may hold a workpiece, such as the handle, and may be adhered to the device with cost efficient means. Handle portion may be allowed through said mounting hole and may be shaped in a fashion wherein the components singularly and together may be structured in particular dimensions to provide for a strength, weight and cost restraint.

In one or more embodiments, which may be in addition to the above and below embodiments, the aforementioned mounting hole may exist on varying locations along the device, and not limited to the expansion card socket head fixed to the drive shaft. These components, individually or together, may allow for use of a handle for the device, in one or other iterations such that the handle may be rotated and as aforementioned provide for toque to turn the cam. It is also noted that the handle may be described or enacted through any other method such as via a key and hole design, mated surfaces, single pieces design, friction fit, or any other torque transferring design, such that the handle may transfer torque through the structure, or other structures, and such that the cam may be able to move from a lock to unlocked position and vice versa.

In one or more embodiments, the outer side of the housing may be provided with a stop limit means on the angle of rotation of the handle. Stop means may be secured to a housing outer side wall of the shutter. Said handle may include one or multiple of a handle portion, box portion, and arcuate portion, all of which may be connected. The shaft may be rotated along the arcuate portions, and the baffle slidably connected when one side edge portion of the baffle block is parallel to the baffles limit box portion. This may continue along the rotational direction of rotation. The stop may be provided such that the cam is not over rotated, and also such that the tension force provided for keeping the present invention in a locked or unlocked state may be pushed into the stop, such that the handle, and thus socket is provided to stay in the locked or unlocked state until otherwise moved by the user.

It is noted that the exact limitation means may vary based on device construction, cost, and plug considerations, among others. Maximum rotation angles may vary based on device considerations. These and other components may be constructed of varying materials, taking into consideration precautions of cost, weight, and safety variety such that the desired function is achieved without significant compromise otherwise.

In one or more embodiments, which may be in addition to the above and below embodiments, the locking piece of the electrical socket described herein may comprise of a front end and the end of the transition section, which may allow for the leading and trailing ends to be connected by a transition portion. The transition portion may be pivotally connected to the positioning axis; the leading and trailing ends of the extension lines may intersect, and the direction toward the elliptical cam angle may be an obtuse angle greater than 150 degrees, but also maybe any angle such that the cam may provide for the locking and locking ranges. Turning the cam lock may change its ellipse major and minor axes, which may maneuver two lock pieces positioned at the front end of the hook into position aligned according to the corresponding positioning grooves on the copper socket. Exact angles and procedure may vary based on considerations of cost and functionality, among others. Such movement may plug the hole on the sheet and may position the plug lock in the socket.

In one or more embodiments, which may be in addition to the above and below embodiments, the locking mechanism, with conductors may be secured within a housing.

In one or more embodiments, which may be in addition to the above and below embodiments, the locking mechanism, with conductors may be secured within a housing wherein the housing, socket or plug is a standard style or pattern plug, housing or socket.

In one or more embodiments, which may be in addition to the above and below embodiments, the locking mechanism, with conductors may be secured within a housing wherein the socket, housing or plug is a NEMA 5-15, 5-20, 1-15 or any other type of housing, socket or plug wherein the locking mechanism is operable to hold the plug blades.

In one or more embodiments, which may be in addition to the above and below embodiments, wherein the locking mechanism, with conductors may be secured within a housing wherein the socket, housing or plug is an industrial, commercial or any other type of socket, plug or housing, wherein the locking mechanism is operable to hold the plug blades or prongs.

In one or more embodiments, which may be in addition to the above and below embodiments, the locking mechanism, with conductors may be secured within a housing wherein the socket, housing or plug are an industrial, commercial or any other type of socket, housing or plug such as NEMA 14 plugs including NEMA 14-30, 14-50 and any other NEMA, IEC, ITA or any other standardized commercial, consumer or industrial plug, wherein the locking mechanism is operable to hold the plug blades or prongs.

In one or more embodiments, which may be in addition to the above and below embodiments, wherein the socket, plug or housing may be rated for intrusion such as IP 67 or another other IP rating or other issuing body or rating such as for liquid, dust, shock or other intrusion.

In one or more embodiments, which may be in addition to the above and below embodiments, the locking mechanism, with conductors may be secured wherein the receptacle may include a ground socket, wherein a ground blade or pin may be entered from the plug to be secured. It is noted that in a preferred embodiment the ground blade is not secured, but it is appreciably understood that the same application of the cam locking mechanism can be applied to the ground blade.

In one or more embodiments, which may be in addition to the above and below embodiments, the locking mechanism, with conductors may be secured wherein the receptacle may include a ground socket, wherein the ground socket is above or below the mechanism where, the locking cam and shaft are on the opposite side of the ground receptacle such that the centered ground receptacle does not impede on the locking mechanism.

In one or more embodiments, which may be in addition to the above and below embodiments, the locking mechanism, with conductors may be secured wherein the receptacle may include a ground socket, wherein the ground socket is above or below the mechanism where, the locking cam and shaft are on the opposite side of the ground receptacle such that the centered ground receptacle does not impede on the locking mechanism such as wherein the pin does not transverse the entire receptacle, but wherein the end of the shaft is captive within the housing, such that the shaft or pin is captive within the housing and wherein then the ground receptacle is unhindered.

In one or more embodiments, which may be in addition to the above and below embodiments, the locking mechanism may be mounted in a housing, wherein the housing is made of any type of material, but is appreciably a form of plastic, but also may be metal, alloy or any other type of synthetic or natural substance one skilled in the art would foresee.

In one or more embodiments, which may be in addition to the above and below embodiments, the conductors including the ground and two hot and neutral, or positive and negative conductor outputs may be housing within the housing, such that then single pole, double pole, three pole, or multi pole wire may enter the housing and thus be connected to the corresponding conductors, such that then the wire is molded, connected, formed with or otherwise connected to the housing, such that the then the plug housing, with locking mechanism becomes formed such as similar to a standard plug and wire, but with the ingenious locking mechanism.

In one or more embodiments, which may be in addition to the above and below embodiments, wherein the wire is shielded or of any type, gauge thickness, material, color rating, etc.

In one or more embodiments, which may be in addition to the above and below embodiments, wherein the wires connected to the conductors are attached by crimping, form in mold process, soldering or any other method, such that current is able to flow to or from the wire into the conductors and into the secured blades to be transferred to or from that which is connected to the secured socket.

In one or more embodiments, which may be in addition to the above and below embodiments, wherein the wire on the opposite end of the locking socket and housing is a standard male or female NEMA receptacle or socket.

In one or more embodiments, which may be in addition to the above and below embodiments, wherein the wire on the opposite end of the locking socket and housing is another locking socket or receptacle.

In one or more embodiments, which may be in addition to the above and below embodiments, wherein the locking receptacle may include multiple locking mechanism and sockets.

In one or more embodiments, which may be in addition to the above and below embodiments, wherein the locking receptacle may include multiple locking mechanism and sockets such as two locking sockets.

In one or more embodiments, which may be in addition to the above and below embodiments, wherein the locking receptacle may include multiple locking mechanism and sockets such as three or more locking sockets.

In one or more embodiments, which may be in addition to the above and below embodiments, wherein the locking receptacle may include multiple locking mechanism and sockets such as where the locking sockets are stacked vertically in a housing.

In one or more embodiments, which may be in addition to the above and below embodiments, wherein the locking receptacle may include multiple locking mechanism and sockets such as where the locking sockets are arranged horizontal in a housing.

In one or more embodiments, which may be in addition to the above and below embodiments, wherein the locking receptacle may include multiple locking mechanism and sockets such as where the locking sockets are arranged in a housing, such a mountable housing for a wall plug, or any other mountable housing, or non-mountable housing such as previously described, wherein the housing includes a square or rectangle grid of any plurality of lockable sockets, wherein the locking mechanism are positioned on the exterior edge of the housing, such that each is lockable.

In one or more embodiments, which may be in addition to the above and below embodiments, wherein the locking receptacle may include multiple locking mechanism and sockets such as where the locking sockets are arranged in a housing wherein the receptacles coalesce to a single circuit, which is provided by the wire as aforementioned.

In one or more embodiments, which may be in addition to the above and below embodiments, wherein the locking receptacle may include multiple locking mechanism and sockets such as where the locking sockets are arranged in a housing wherein the receptacles coalesce to a multiple circuit, which is provided by the wire as aforementioned.

In one or more embodiments, which may be in addition to the above and below embodiments, wherein the locking receptacle may include multiple locking mechanism and sockets such as where the locking sockets are arranged in a housing wherein the receptacles coalesce to a multiple circuits, which is provided by multiple wires.

In one or more embodiments, which may be in addition to the above and below embodiments, wherein the locking receptacle may include multiple locking mechanism and sockets and of which are of any rating limited by the conductors, wires, or supply.

Referring to FIG. 1, a secure socket proposed utility model of the present embodiment may include a housing split into two parts, 180 and 170. Encased in the housing 170 and 180 may be plug conductors 110 where two copper or other metallic sockets 110*a*, wherein a wire or wires may be connected to 110*b* conductor of which electricity can flow to or from the plugs attached or inputted into 110*a*. The device may further comprise of a housing disposed members within the elliptical cam 160, drive shaft 150, locking fingers 120, the elastic member 140 and the positioning shaft 130; oval cam 160 may be disposed intermediate the two copper outlets 110*a*; transmission shaft 150 through the side wall of the housing and fixedly connected to the oval cam 160 of the axial portion, positioning shaft 130 comprises two symmetrically disposed members at both sides of the oval cam 160, and may be fixed to the housing wall; lock piece 120 may include two symmetrically members which may be disposed in the oval cam 160, may be driven by rotation of two elliptical cam 160 side, and may be pivotally connected to respective locating shaft 130, distal end of the two locking members 120 may be respectively may be provided with a side opposite to the hook; an elastic member 140 comprises two symmetrically disposed members at both sides of the oval cam 160 and set may be on the opposite outer surfaces of the trailing end of the lock piece 120, one end of the elastic pressing member 140 may contact the inner wall of said housing, the other end of the trailing end may contact the corresponding locking fingers 120 to the outside; both sides of the position of outlet copper plug 110*b* in contact with the sheet may be provided with a corresponding plug hole on the sheet positioning groove. It is noted that additional intricacies of the lock piece 120 may be found in FIG. 7 and conductor 110 may be found in FIG. 8.

In a particular embodiment, copper may be provided on the socket 110*a* with positioning holes, positioning pins may be provided on the housing socket with copper through the positioning holes and the positioning pins mounted within the housing. Said elliptical cam 160 may be disposed between the two sockets 110*a* of copper, typically disposed at one side near the bottom of the housing, so as to leave the holding portion 110*a* of the socket copper sheet 810*a* in position, oval cam 160 and the drive shaft 150 may be generally made of insulating material, improve the safe use, and may be made of hard plastic and other materials.

In a particular embodiment, the positioning shaft 130 and locking tab 120 may be pivoted, turned or otherwise moved by the user, which may be equivalent to a fulcrum for both directional ends of movement of the locking tab 120, and as the cam moved the locking tab is able to engage the friction or other aforementioned method to secure or lock the plug within the socket. Also, instead, the outer two positioning members relative to the socket 110*a* in two copper axes 130 ships were set, that may be, opposite of the two opposite outer copper receptacle 110*b*. 120 corresponds to the above-mentioned lock piece strut lever of which may be provided with a hook on its front end, a rear end and then moved by the control the front end to control the movement of the hooks as details of the piece may more easily seen in an alternate view in FIG. 7 as well. The elastic member 140 may provide the restoring force of the lock piece 120 to the device; when the two major axis vertices 120 oval-shaped cam 160 press the lock piece, two resilient members 140 may provide a locking tab 120 back in situ restoring force, so that the two locking fingers 120 hold oval cam 160 to prevent the oval cam 160 from rotating freely.

In this embodiment, the elastic member 140 may be a compression spring and in other embodiments may be of any other device. Corresponding to one side of the locking sheet spring 120 may be set the FIG. 7 projection 722*a*, extending into the spring along the axis of compression spring to prevent displacement.

In some embodiments, the casing may be generally bonded to each other on the lid shell 170 and lower shell 180. Upper shell 170 and lower shell 180 may be provided within the limits of elliptical cam 160, the locking piece 120, such that the rotating shift member may drive shaft 150 through the lower shell 180 may be provided, and further the inside of the upper casing 170 may be provided with a corresponding oval cam limit groove. This end stop groove can also set up the circular groove 160, the shaft 150 can extend through the oval cam 160 and extending into the circular groove at the top against the bottom of the circular groove.

In a particular embodiment, the safety socket may be the American type socket 5-15, wherein there may be three jack sockets, a ground socket, respectively, as well as the zero line and FireWire socket or any other type of sockets or plugs. The ground socket may be round or any geometric shape, while the zero line and FireWire jacks may be typically rectangular and parallel to each other, but it is also noted that the plug and socket combination may appreciably be any design, shape or have any other characteristic. It is noted that the type of jack, sockets, or otherwise may be of any standard, design or type. The jack inside the zero line and the line of fire may be provided corresponding to a socket copper 20.5-15 socket housing including an upper shell 170 and lower shell 180, upper shell 170 and lower shell 180 cover each other to form an accommodating space 110 copper socket set, oval-shaped cam 160, the locking tab 120 and other components.

In a particular embodiment, the upper shell 170 and lower shell 180 may be provided with installation jack shaft 130 positioned at both ends of two positioning axes 130 which may be respectively inserted into the mounting socket in the installation. Positioning shaft 130 may be pivoted on a lock piece 120 wherein locking fingers on the FIG. 7 front end 721 may be provided with a hook 721*a*, the end of the outer spring 722 may be connected which may set the oval cam 160 between the inside of the rear end 120 with FIG. 7 two locking fingers 722, elliptical cam shaft 160 may be connected to the lower shell 150 through 180 settings, and may be located in the outer casing 180 attached to the end of the handle (451 in FIG. 4).

Figure 4:
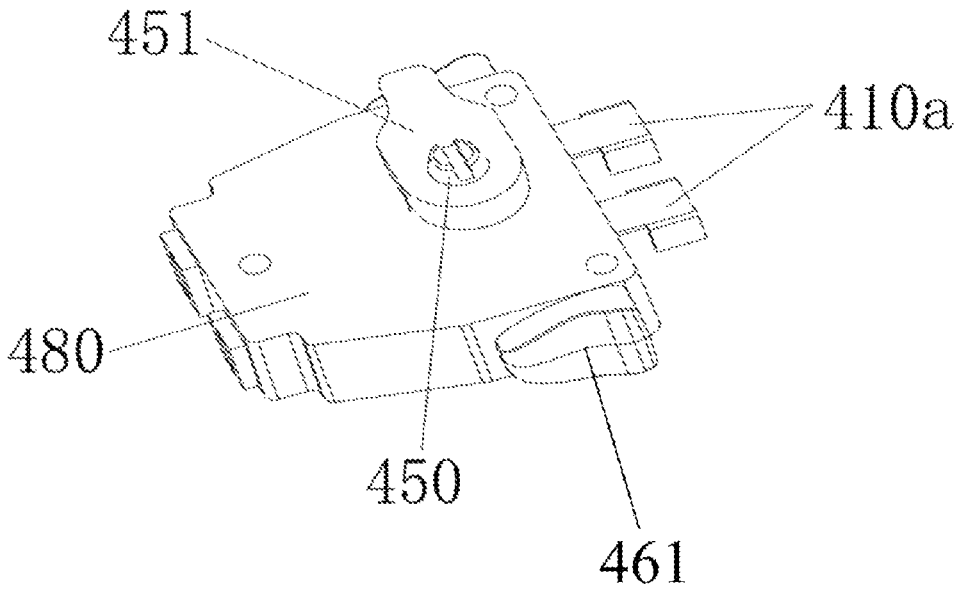
FIG. 4 is a schematic of an embodiment of the safe outlet of the utility model.

In a particular embodiment, when turning the FIG. 4 handle 451 through the shaft 450 drive cam 160 may rotate, elliptical cam 160, due to changes in the length of the shaft, may squeeze and pine open the lock piece 120. The lock piece 120, under the control of the compression spring and elliptical cam 160, may drive the hook FIG. 7 721*a* such that it may be inserted or pulled out of the positioning grooves 810*b* and the plug hole or recess. For example, when the oval cam 160 may be positioned with two major axis vertices squeezing two locking tab 120, the FIG. 7 hook 721*a* may be inserted into the positioning groove 810*b* and plug the hole in the sheet, the locking plug and socket. Accordingly, the oval cam 160 with two minor axis vertices may squeeze when two locking tab 120, and the FIG. 7 hook 721*a* may be pulled out of the plug hole sheet of the state, so that the receptacle can be as safe as conventional socket use.

Also, instead, the outer two positioning members relative to the FIG. 1 socket 110*a* in two copper axes 130 were set, that may be, opposite of the two opposite outer copper receptacle 110*b*. Then, 120 corresponds to the above-mentioned lock piece strut lever and FIG. 7 721 may be provided with a hook 721*a* on its front end, a rear end and then moved by the control 722, the front end 721 to control the movement of the FIG. 5 hooks 511. The elastic member 140 may provide the restoring force of the lock piece 120 to the device; when the two major axis vertices 120 oval-shaped cam 160 press the lock piece, two resilient members 140 may provide a locking tab 120 back in situ restoring force, so that the two locking fingers 120 hold oval cam 160 to prevent the oval cam 160 from rotating freely.

Figure 2:
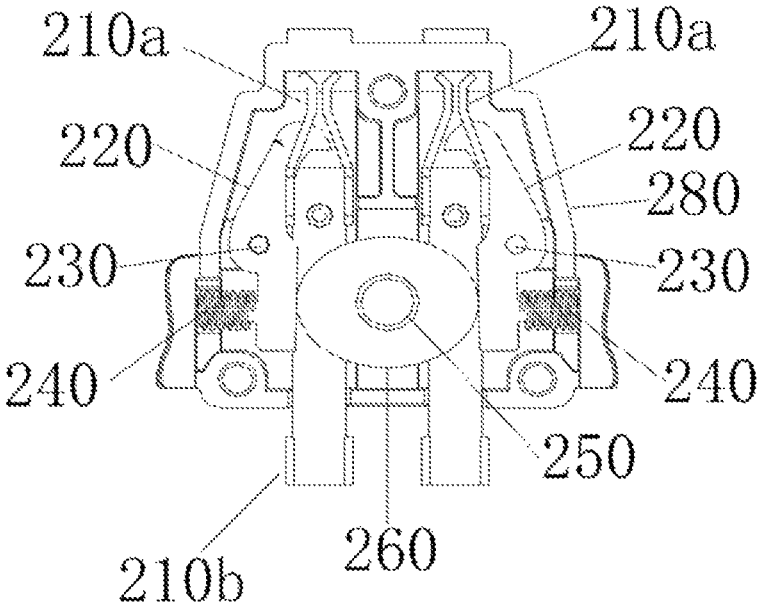
FIG. 2 is a diagram of an embodiment of the utility model lock piece to an embodiment in the locked state.

Referring to FIG. 2, when the plug may be inserted into the safety socket, drive shaft 250 driven by an oval cam 260 may rotate. Accordingly, two major axis vertices oval cam 260 to the sides may press the lock piece as seen in further detail in FIG. 7, but in a brief overview may provide for locking tab 220 positioned along the axis of rotation, or holding pin 230, the locking tab 220 may act against the spring acting elastic member 240, wherein then the sheet tip 220 may through enact force of the outlet copper locating slot 210 and thus on the plug which may be inserted into the hole in the sheet wherein then the plug is conductively mated to 210*a*. This may be enacted when oval cam shaft 250 to drive 260 rotates, the contact end may be elliptical cam 260 and the lock piece 220 of the major axis to the minor vertex changes. Accordingly, the elastic member 240 may press the lock piece outside of the rear end of the locking tab 220 with 220 positioned along the axis of rotation 230 and the front end of the lock piece hooks may pull the plug hole sheet, and the plug may be pulled free safety socket.

Figure 3:
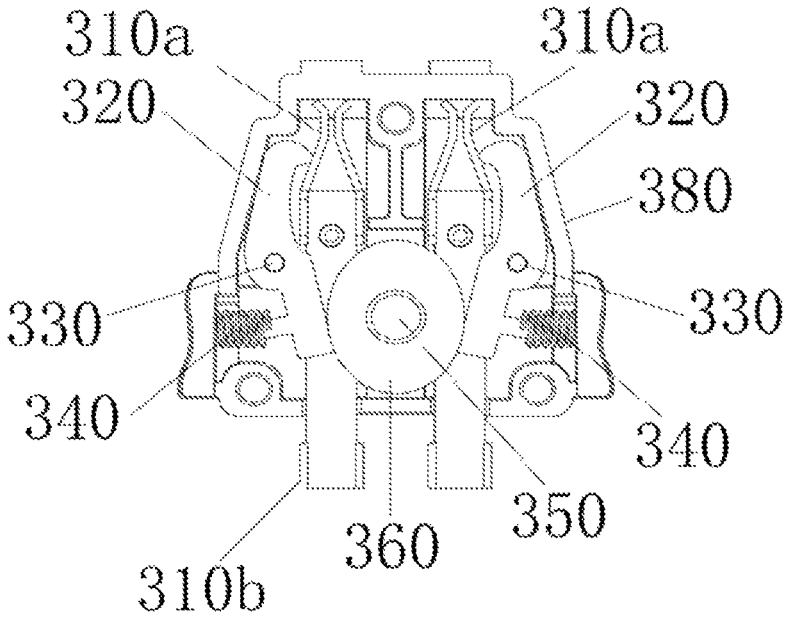
FIG. 3 is diagram of an embodiment of the utility model lock piece to an embodiment in the release state.

Referring to FIG. 3, it is demonstrated that FIG. 3 provides appreciably the same view and components as FIG. 2, as aforementioned. However, FIG. 3 provides that the oval cam shaft 350, wherein the corresponding FIG. 2 describes oval camshaft 250, is in a released or unlocked state, wherein the cam 350 is positioned such that, when as shown in FIG. 3, turned, such that pressure is not placed on the socket and holding portions, such that the socket or plug is not in the locked state. It is noted, as aforementioned, that the converse of the locking position, is provided as such in the released or unlocked state, such that the cam resists a momentary movement, until moved by the user's hand via the cam's position and tension, and additionally that the cam provides for a released state, wherein the plug or socket may be unconnected.

It is noted that the cam in the position as shown in FIG. 3, an unlocked state, that a plug may be inserted into the safety socket and wherein the plug then electrically connects to 310 which can then flow electricity to or from a wire or wires connected to 310*b*. The drive shaft 350 driven by an oval cam 360 may rotate. Accordingly, two major axis vertices oval cam 360 to the sides may press the lock piece as seen in further detail in FIG. 7, but in a brief overview may provide for locking tab 320 positioned along the axis of rotation, or holding pin 330, the locking tab 320 may act against the spring acting elastic member 340, wherein then the sheet tip 320 sheet tip may through enact force of the outlet copper locating slot 310 and thus on the plug which may be inserted into the hole in the sheet wherein then the plug is conductively mated to 310*a*, but as show is retracted when the cam and shaft are in the unlocked position, such that a plug may be removed or entered without hindrance in position. This may be enacted when oval cam shaft 350 to drive 360 rotates, the contact end may be elliptical cam 360 and the lock piece 320 of the major axis to the minor vertex changes. Accordingly, the elastic member 340 may press the lock piece outside of the rear end of the locking tab 320 positioned along the axis of rotation 330 and the front end of the lock piece hooks may pull the plug hole sheet, and the plug may be pulled free safety socket.

Referring to FIG. 4, a perspective view of an embodiment of the present invention secure socket may be taught. FIG. 4 provides for the housing 480 making up the structure of the device, such that there are also holding handles 461 on each side of the device, which may provide for grip and ease of the user to interact with the device. It is noted that the movable toggle 451, of which may be affixed by a shaft and screw 450, which may provide for the ability of the user to apply torque to spin or move the cam, such that the plug is able to lock and unlock. Also noted are the extruding positioning grooves 410 of which may provide for a conductive area for the electricity or current to flow into the corresponding plug or socket, of which may be provided to be connected via the cams in a locked or unlocked state and such that the connection may be made secure. Additionally, referring to FIG. 4, in one embodiment, the above-described drive shaft 450 is located outside the housing is provided with a handle portion 451, the handle 451 may be provided to improve the convenience of the user, the handle may slip disc 451, or with a wrench disk and so on.

Figure 5:
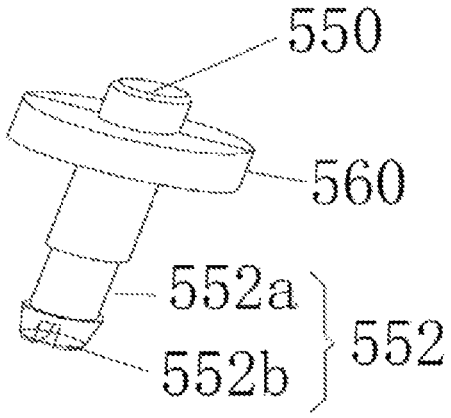
FIG. 5 is a utility model structure of an embodiment of the drive shaft and the elliptical cam schematic.

Referring to FIG. 5, in this embodiment, the free end of said shaft 550 may be provided with expansion chuck 552 wherein the socket head 552 may be fixed to the shaft 550, but wherein the head may be any type of fastener. In addition, chuck 552 may be generally comprising of an expansion head 552*b* and may be through the mounting hole 615*d* of FIG. 6, along with the adapter slot 552*a*, of which may be less diameter as to fit in the mounting hole but not allow for the chuck 552 to slide out of the housing as well as for turning or releasing, such as for maintenance or installation. In addition, 552*b* head extrusion expand after the inner groove 552*a*, the expansion head 552*b* may be compressed and partially reset, such that the chuck may be fixed to the limit in the slot 552*a* and not slide out in either direction in the mounting hole 615*d* of FIG. 6. This may allow for components of a device which may be of simple structure and easy installation as well as reduced cost.

Figure 6:
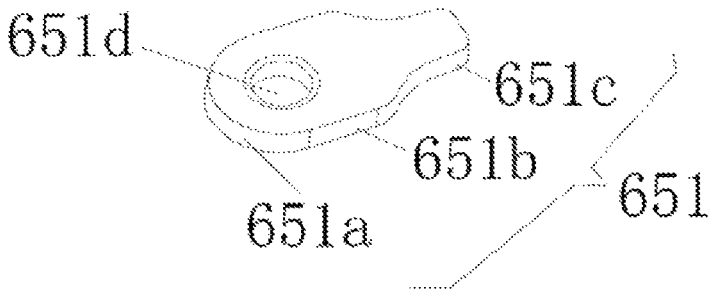
FIG. 6 is a schematic view of an embodiment of the structure of the utility model and particularly of the handle.

Referring to FIG. 6, the handle 651 may be provided with a mounting hole 651*d*, the handle 651 allowed through the mounting holes 615*d* in the expansion card the FIG. 5 socket head 552 fixed to the shaft 550. The mounting hole 615*d* may be generally a non-circular hole, such as a square hole like the expander, with FIG. 5 chuck 552 generally comprising of an expansion head 552*b* and the mounting hole 615*d* of the adapter card slot 552*a*. When the handle 651 of the mounting holes 615*d* and FIG. 5 552*b* head extrusion expand after the inner groove 552*a*, the expansion head 552*b* may be compressed and partially reset, such that the handle 651 may be fixed to the limit in the slot 552*a*, components of a device which may be of simple structure and easy installation.

In this embodiment, the outer side of the housing may be provided with a handle 651 to limit the rotational angle limiting means, wherein the limiting means may be fixed to a housing outer side wall of the shutter, wherein the handle 651 may include a handle portion 651*c* connected in turn, arcuate portion 651*b* and a block 651*a*, when the arc portion 651*a* along the FIG. 1 drive shaft 150 may be rotated, and the shutter slidably connected, when the block 651*b* and a side baffle parallel to the baffle stopper block 651*b* continue to rotate in the direction of rotation. The arc portion and a block portion side chord length of 651*a* to 651*b* in the same block with the stopper portion 651*b* may be located at the side of the arc portion 651*a* on both sides of the contact, and restricted rotation of the handle 651 may continue along the original direction of rotation. Note that the handle 651 may be the limit baffle, and in the FIG. 1 oval cam two major axis vertices 160 may be in a state of pressing the lock piece.

It is noted that the above-described FIG. 1 drive shaft 150 may be located outside the housing and may be provided with a handle portion 651. The handle 651 may be provided to improve the convenience of the user, the handle may slip disc 651, or with a wrench disk and so on.

It is noted that it can be seen how the compression spring may be of any other type of elastic, tension or force able piece, such as a torsion bar elastic piece, or other design such that the socket and plug are forcibly connected. It may be seen that a torsion piece, such as a long bar of which may be metal, plastic or any type of material may be used to press force via the cam, and via the structure itself onto the locking plug.

Figure 7:
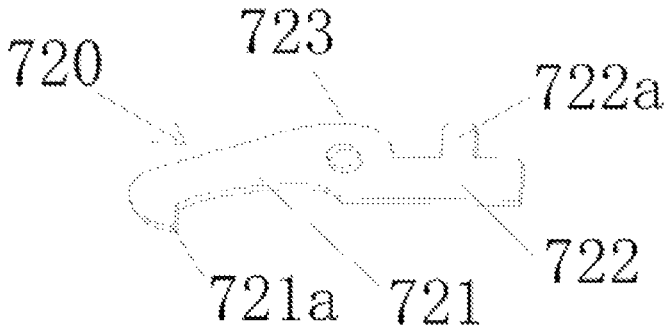
FIG. 7 is a schematic view of an embodiment of the lock piece of the utility model.

Referring to FIG. 7, the locking piece 720 may include a front end 721 and rear end turn portions 722 and 723; 721 of the leading end 723 and trailing end 722 connected through the turn portion, the transition portion 723 may be pivotally connected to the positioning of the FIG. 1 shaft 130; the front end 721 and a trailing end of the extension line 722 intersect, and FIG. 1 160 toward the direction of elliptical cam angle obtuse angle greater than 150 degrees. This structure of the FIG. 1 lock piece 120, may be inclined towards the front end of the receptacle 721 may be copper or any other conductive metal and may reduce the size of the front end of the housing. The locking tab may be formed with required settings, easy production and installation, and generally by reliable hardened copper, stainless steel sheet or other suitable material given specific restrictions and desired function.

A secure socket of this embodiment may have some two round holes use of the lock piece hooked on the hook 721*a* plug following use of American NEMA standard plug inserts inserted two hole sheet, the FIG. 1 plug 120 fixed in the socket, such that pull out may be prevented. By turning the oval cam, changing FIG. 1 major and minor axes 160 while controlling the two locking hooks 721*a*, sheet tip 721 may enter into the corresponding FIG. 8 socket hole positioning grooves 810 and 810*b* for plug-chips, locking in place in the socket; with the security of this embodiment, when there arises a need to lock the plug, the knob on the handle shaft may be used at the designated location. When not locking plug, just to the FIG. 1 drive shaft 150 on the same it handles to the specified location to another, as a regular outlet to use. With respect to the locking structure of the prior art, the structure may be simple, easy to use, lower production costs.

In some embodiments, wherein 720 of the trailing end 722 outside of the locking tab 720 positioned along the FIG. 1 axis of rotation 130, the trailing end 722 of the locking tab 720 may act against the spring acting FIG. 2 elastic member 240, the locking hook 721*a*, tip 721 through FIG. 2 outlet copper locating slot 210 on the plug may be inserted into the hole in the sheet, per the plug safety socket restrictions; when FIG. 2 oval cam shaft 250 to drive 260 rotates, the contact end may be elliptical cam 260 and the lock piece 720 of the major axis to the minor vertex changes. Accordingly, the elastic member, in FIG. 2, 240 may press the lock piece 722 outside of the rear end of the locking tab 720 with 720 positioned along the axis of rotation 230, the front end of the lock piece 721 720 721*a* hooks may pull the plug hole sheet, and the plug may be pulled free safety socket.

Figure 8:
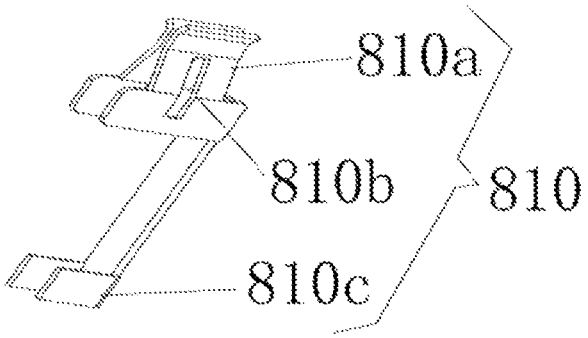
FIG. 8 is a schematic of an embodiment of the receptacle of the copper section of the utility model.

Referring to FIG. 8, in this or other embodiments, the FIG. 1 front end 110*a* of the socket copper holding portion 810, the holding portion 810*a* may be disposed opposite the two copper clips to grip the plug insert, i.e. the positioning groove 810*b* may be provided on the holding portion 810*a* of the two on a copper clip positioning groove 810*b* may be generally shaped through-holes. After holding portion 810*a* and a side surface perpendicular to the two copper clips to connect the copper or other material piece which may move through the bottom of the FIG. 1 housing 110 of the FIG. 7 connector receptacle copper trailing end 722, the trailing end 722 may be generally U-shaped copper 810*c*, and convenient wire connections such that a wire may be connected.

Figure 9:
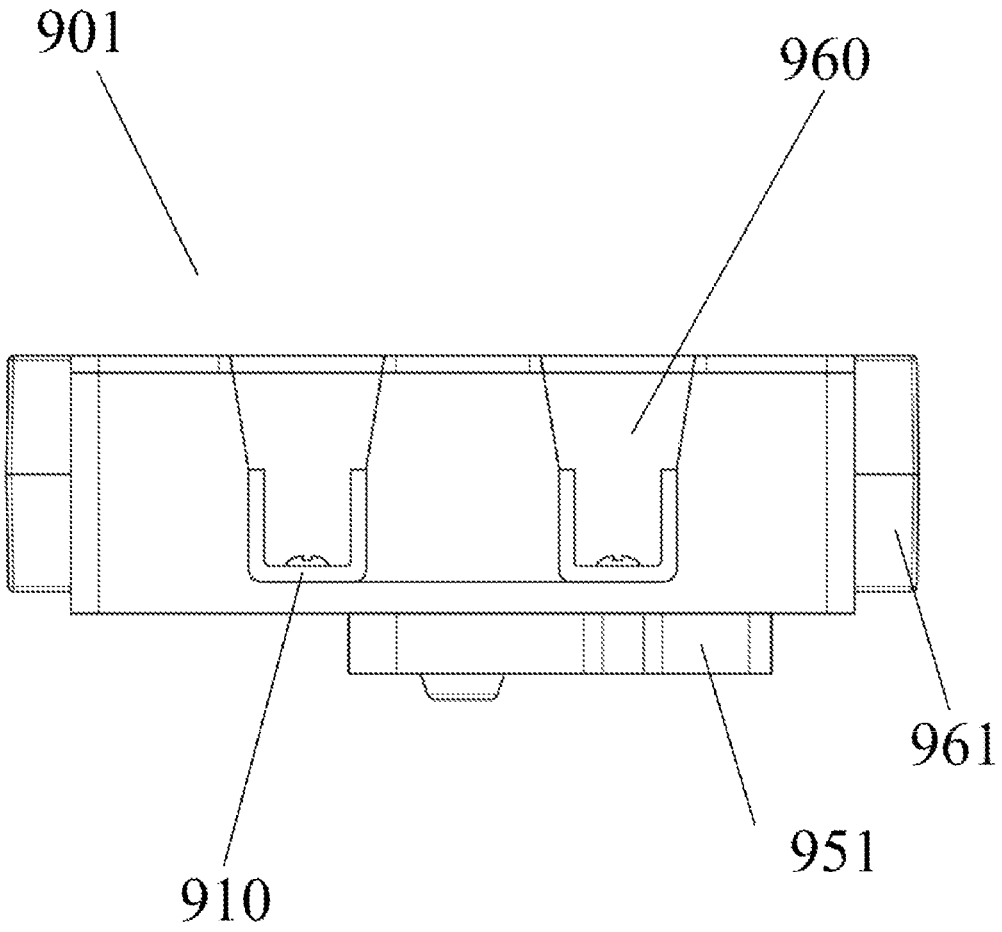
FIG. 9 is a front view of an embodiment of the locking receptacle wherein a plug may plug into the locking socket.

Referring to FIG. 9, the present embodiment may refer to a front view of the locking receptacle of the device, wherein a plug may enter the socket. Said device 901 may be gripped by its housing and provided grips 961 by the user, among other easily accessible or understood holding styles, such as otherwise on the exterior of the device. Provided recesses 960 in the device may exist in singularity or in multiplicity, and in any plurality, as aforementioned and as described in the embodiment, such that desired plugs may be used and material such as prongs or convenient wire connections may be housed. These recesses may allow for the prongs of said plug to be inserted into the device. U-grooves 910, of which are part of the conductive blade and copper piece, of which is aforementioned in the above embodiments, and of which may conduct or transfer electricity, may exist on the trailing end of the recess to provide support for inserted material, providing guidance of entry and increased stability.

In a particular embodiment, handle 951 may be able to pivot, allowing for functionality of the locking mechanism as described above, such that the handle through the user's movements, may provide torque to turn a shaft, of which is not viewable in FIG. 9, but of which may be viewable in other figures, of which the shaft may turn the not in view cam, of which may secure the sockets, prongs or plugs into the device. Said handle 951 may be attached to the device by some shaft 550 such that rotation of the cams and locking hooks 220 may lock an inserted plug within the device. It is noted that again, the shaft and hooks are obscured from view in FIG. 9, but are within view in other figure views. It is noted that the handle, as described may also be presented in a another geometric shape, and may also have any characteristic of thickness, or extrusion, such as nubs at the end of the hand, such that a user's hand or fingers may more readily or easily be able to grip the handle, and provide torque to the handle, and appreciably then the shaft and cam as aforementioned.

Figure 10A:
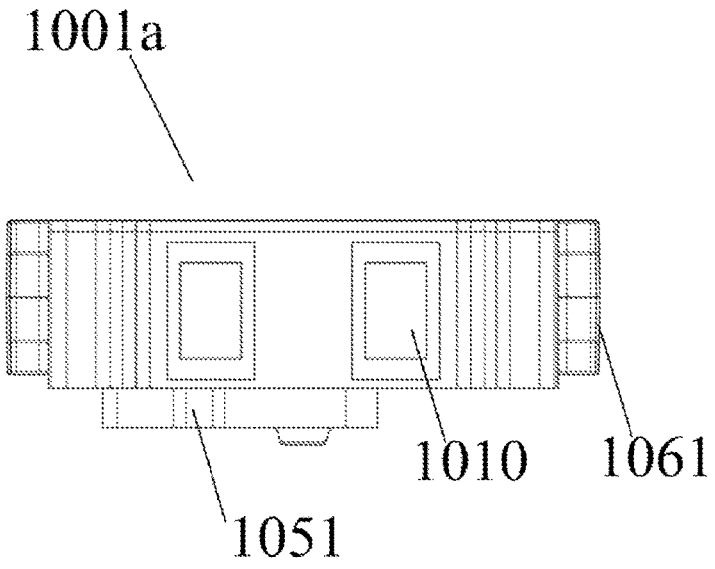
FIGS. 10*a* and 10*b* are back view of an embodiment of the locking receptacle wherein a plug may plug into the locking socket.

FIG. 10*a* may refer to a back view of an embodiment of the locking receptacle of the lockable socket device. Said device may be gripped by its housing 1001*a*, of which it is noted that the housing may be appreciably larger than as pictured or of a different design, but may be provided grips 1061, or otherwise on the exterior of the device. Hollowed cavities 1010 may exist in multiplicity as shown or in singularity, depending on desired plug compatibility. Said cavities may provide housing of plug prongs as aforementioned. Handle 1051 may be attached to the device by some shaft 550 not pictured, but seen in other figures such as FIG. 5, such that rotation of locking hooks 220 such as in FIG. 2 may lock inserted plug within the device.

Figure 10B:
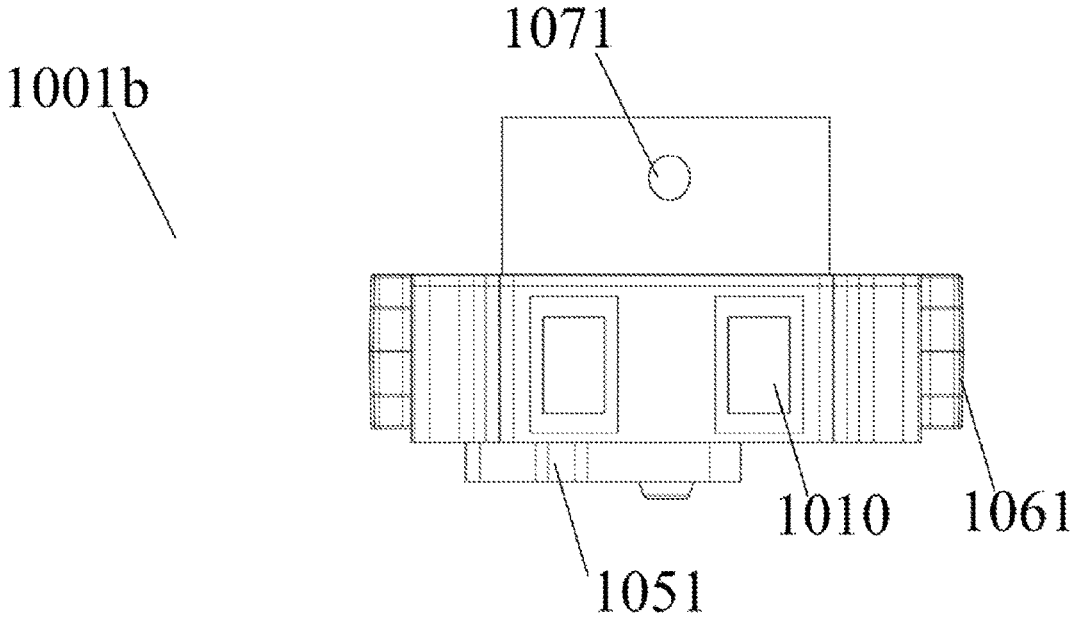

FIG. 10*b* may refer to a back view of an embodiment of the locking receptacle of the lockable socket device. Said device may be gripped by its housing 1001*b*, of which it is noted that the housing may be appreciably larger or of a different design than as pictured or of a different design, but may be provided grips 1061, or otherwise on the exterior of the device. Hollowed cavities 1010 may exist in multiplicity as shown or in singularity, depending on desired plug compatibility. Said cavities may provide housing of plug prongs as aforementioned. Handle 1051 may be attached to the device by some shaft 550 not pictured, but seen in other figures such as FIG. 5, such that rotation of locking hooks 220 such as in FIG. 2 may lock inserted plug within the device. Additionally, the housing may extended to provide additional abilities to include other recesses or connected, such as at least one ground or neutral female receptacle 1071 for three prong plugs such as for NEMA 5-15. It is noted that in a preferred embodiment, the ground receptacle is not lockable, but it is imaginable that is some embodiments the additional receptacles may be locked.

Figure 11A:
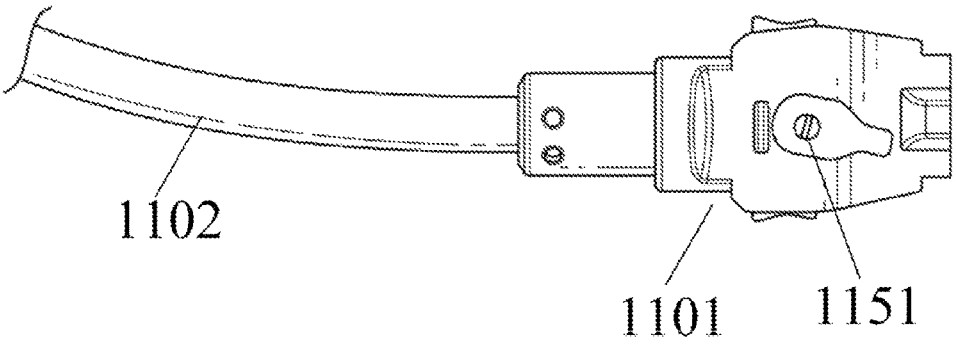
FIGS. 11*a*, 11*b* and 11*c* are side and top views of an embodiment of the present invention wherein the locking receptacle is connected to a wire and provides an ornate and robust plug housing.
Figure 11B:
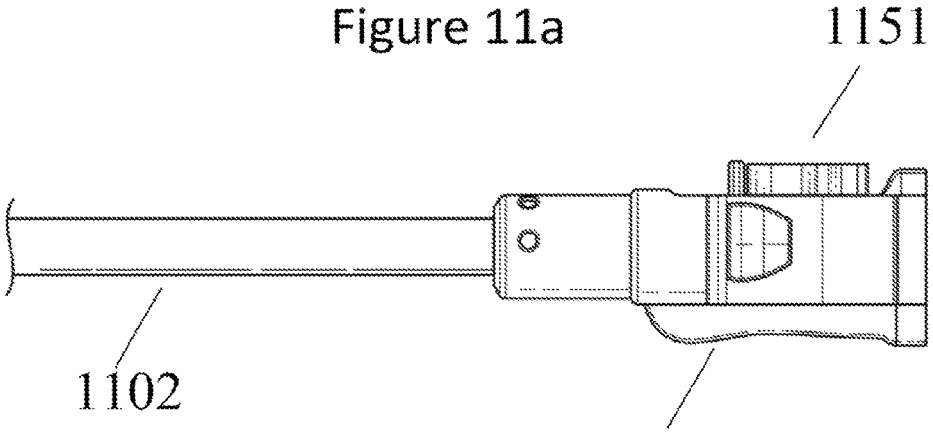
Figure 11C:
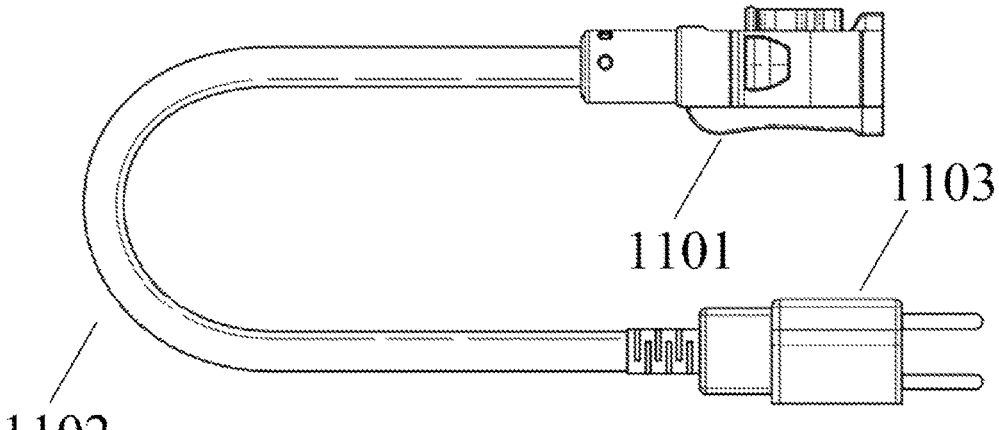

FIGS. 11*a*, 11*b* and 11*c* are side and top views of an embodiment of the present invention wherein the locking receptacle is connected to a wire and provides an ornate and robust plug housing.

FIG. 11*a* provides a top view of the locking receptacle 1101, of which may be housed in an ornate, functional or robust housing, of which may be similar to as pictured, but may be inherently different design due to construction, cost, and needs of consumer, manufacturing, or design as one skilled in the art would easily for see. The 1101 housing may include then the locking mechanism extruding from the housing, such that the toggle may be switched in any fashion it is noted that the toggle may be 180 degree, 90 degrees or any degrees between lock and unlocking, depending on the aforementioned cam profile. There also may be stops or other impediments for the latch, as well as the latch may provide 360 degrees of rotation depending on the embodiment. The housing and receptacle may connect permanently, or otherwise to a wire such as a three pole or two pole wire 1102.

FIG. 11*b* provides a side view of the locking receptacle wherein the receptacle may provide a housing 1101 as shown, wherein the wherein the housing may include the latch 1151 and wherein the housing and receptacle may include a wire 1102 as aforementioned.

FIG. 11*c* provides a locking receptacle 1101 which may connect to a wire 1102, of any gauge, length, pole plurality, color, material or mount, wherein then on the opposite end a plug 1103 may be connected wherein the plug is of any type, the same type, female, male or of any design.

Figure 12A:
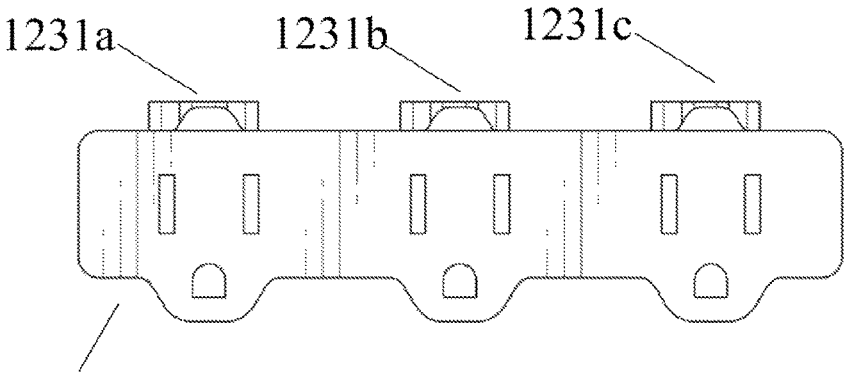
FIGS. 12*a*, 12*b*, 12*c*, 12*d* and 12*e* are side, front and top views of embodiments of the present invention wherein the locking receptacle is connected to a wire and provides an ornate and robust plug housing as well as multiple outlets and locking outlets in the same housing.

FIGS. 12*a*, 12*b*, 12*c*, 12*d* and 12*e* are front, side and top views of embodiments of the present invention wherein the locking receptacle is connected to a wire and provides an ornate and robust plug housing as well as multiple outlets and locking outlets in the same housing FIG. 12*a* provides a front view of an embodiment of the present invention with a housing 1201 of which may housing three receptacles, with each their own locking mechanism with latch 1231*a*, 1231*b* and 1231*c*. It is noted that there may be any plurality of receptacles, and that all, some or one of the receptacles may have the locking components as aforementioned. It is noted that as pictured, the receptacles are three prong NEMA 5-15 but in other embodiments may be any other type.

Figure 12B:
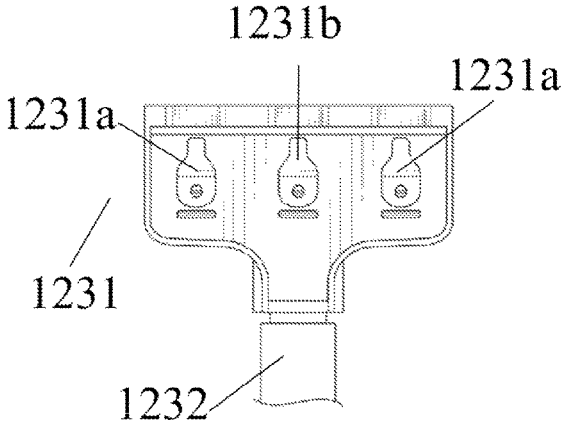

FIG. 12*b* provides a top view of the present invention with housing 1231. The housing may include a connection, of which may be permanent, semi-permanent, or temporary connection to 1232 wire as is aforementioned. It is noted that additionally the locking latch mechanism 1231*a*, 1231*b* and 1231*c* may extrude separately as show. It is noted that it can be seen that the latches may also be replaced by a single latch that actuates all of the cams, such that a single latch locks all of the receptacles. This can be provided for example by a bar actuating all of the cams or other mechanisms one skilled in the art would foresee.

Figure 12C:
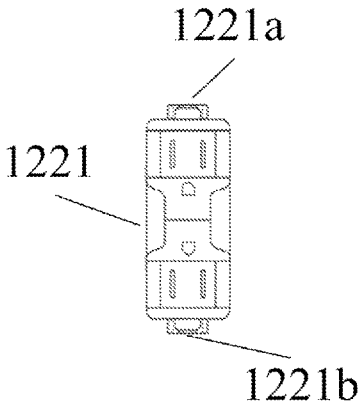

FIG. 12*c* provides a front view of an embodiment, wherein the housing 1221 includes two receptacles and locking mechanisms with latches 1221*a* and 1221*b* of which are stacked. It is noted that the orientation may be reversed as shown, to allow for ease of latching mechanism design. It is also noted that this orientation can easily provide a single latch on one end with the shaft going through the housing to actuate both or more than two cams and locking mechanisms. It is again noted that the design and type of the socket as depicted is for example, and may be any type or style.

Figure 12D:
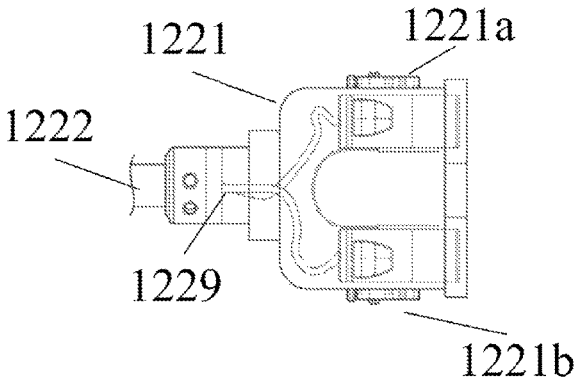

FIG. 12*d* provides a side view of the double stacked receptacles with a clear housing 1221, such that the connections and wires 1229 may be seen to each receptacle, connecting to wire 1222. It can be understood that the wires and wires 1229 may be of any type, gauge, size and plurality as dictated by the type of receptacle, amperage, or any other design need. It is noted that the latches 1221*a* and 1221*b* may extrude from the housing such that they can be latched and unlatched by the user.

Figure 12E:
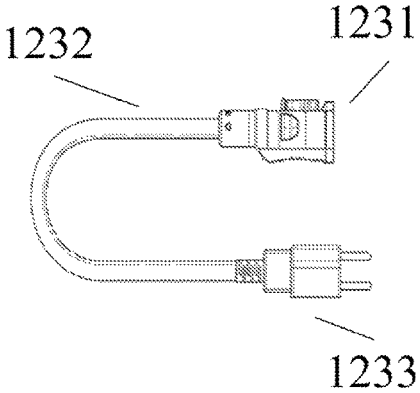

FIG. 12*e* provides a side view of the three locking receptacle housing 1231 connected to wire 1232 and to plug 1233. As aforementioned, the housing may be of any style with any style receptacle, any type, gauge or pole wire 1232, and any style or type of plug 1233.

It is noted that the aforementioned different plurality of plugs may be any plurality side by side, or any plurality stacked or as aforementioned any other design or orientation and plurality.

A number of embodiments have been described. Nevertheless, it will be understood that various modifications may be made without departing from the spirit and scope of the claimed invention. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments may be within the scope of the following claims.

It may be appreciated that the various systems, methods, and apparatus disclosed herein may be embodied in a machine-readable medium and/or a machine accessible medium compatible with a data processing system (e.g., a computer system), and/or may be performed in any order.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

What is claimed is:

1. A socket, wherein the socket is made of:
a housing, wherein the housing includes:
one or more recesses that form a receptacle, wherein
the recesses are able to each accept a prong from a plug,
wherein the prong electrically contacts a conductor in the recess,
wherein the prong is inserted between two extrusions in the conductor,
a locking mechanism for each receptacle, wherein:
the locking mechanism is able to secure the plug in the receptacle in a locked state and
the locking mechanism is able to allow the plug to be removed from the receptacle in an unlocked state,
the locking mechanism includes one or more of:
an user operable latch extruding from a side of the housing,
wherein the latch is connected to a shaft, wherein
the shaft operably rotates a cam, such that the cam pressures one or more pivoting locking tabs,
wherein the profile of the cam pressing on the locking tabs provide increased force on the locking tabs in the locked state.

2. A socket as in claim 1, wherein
the housing is a two piece clamshell.

3. A socket as in claim 1, wherein
the locking mechanism is able to secure the plug in the receptacle from pulling forces on the socket and plug.

4. A socket as in claim 1, wherein
there is one locking tab for each recess and wherein the locking tabs include:
a pin through the locking tab, captive to the housing, such that the locking tab pivots on the pin when pressured by the cam and
a spring connected to the locking tab that pressures the housing and the locking tab such that the locking tab is pressured to the cam and wherein:
when the locking mechanism is in the locked state the locking mechanism is pressured to remain in the locked state and when the locking mechanism is in the unlocked state the locking mechanism is pressured to stay in the unlocked state.

5. A socket as in claim 1, wherein
the locking tab pressures on the conductor extrusions, such that the conductor extrusions hold the prong.

6. A socket as in claim 1, wherein
the locking tab pressures on the prong, such that locking tab holds the prong.

7. A socket as in claim 1, wherein
the one or more recesses form a three pole with ground, NEMA 5-15, receptacle.

8. A socket as in claim 1, wherein
the one or more recesses form a two pole, NEMA 1-15, receptacle.

9. A socket as in claim 1, wherein
the housing houses one more receptacles with locking mechanisms in a stacked orientation.

10. A socket as in claim 1, wherein
the housing houses one more receptacles with locking mechanisms in a side by side orientation.

11. A socket as in claim 1, wherein
the housing houses two stacked oppositely oriented receptacles with locking mechanisms.

12. A socket as in claim 1, wherein
the housing houses three receptacles with locking mechanisms side by side.

13. A socket as in claim 1, wherein
the conductors are connected to one or more wire conductors through a crimp or solder connections, wherein wire conductors make up a wire which exits the housing.

14. A socket as in claim 13, wherein
the housing with locking mechanism which is connected to the wire, which connects to a plug on the opposite end of the wire, such that electricity can flow to and from the prongs held in the locking receptacles and the plug on the opposite end of the wire.

15. A socket as in claim 1, wherein
the housing is made of a plastic.

16. A socket, wherein the socket is made of:
a housing, wherein the housing includes:
one or more recesses that form a receptacle, wherein
the recesses are able to each accept a prong from a plug,
wherein the prong electrically contacts a conductor in the recess,
wherein the prong is inserted between two extrusions in the conductor, wherein
the conductors are connected to one or more wire conductors through a crimp or solder connections, wherein wire conductors make up a wire which exits the housing,
a locking mechanism for each receptacle, wherein: the locking mechanism includes:
an user operable latch extruding from a side of the housing,
wherein:
the latch is connected to a shaft, wherein
the shaft operably rotates a cam, such that the cam pressures one or more pivoting locking tabs,
the profile of the cam pressing on the locking tabs provide increased force on the locking tabs in the locked state and
the locking mechanism is able to secure the plug in the receptacle from pulling forces on the socket and plug and wherein the locking mechanism is able to secure the plug in the receptacle in a locked state and allow the plug to be removed from the receptacle in an unlocked state.

17. A socket as in claim 16, wherein
there is one locking tab for each recess and wherein the locking tabs include:
a pin through the locking tab, captive to the housing, such that the locking tab pivots on the pin when pressured by the cam and
a spring connected to the locking tab that pressures the housing and the locking tab such that the locking tab is pressured to the cam and wherein:
when the locking mechanism is in the locked state the locking mechanism is pressured to remain in the locked state and
when the locking mechanism is in the unlocked state the locking mechanism is pressured to stay in the unlocked state.

18. A socket as in claim 16, wherein
the locking tab pressures on the prongs such that locking tabs hold the prong.

19. A socket as in claim 16, wherein
the housing houses one more receptacles with locking mechanisms.

* * * * *